US007422018B2

(12) United States Patent
Dieudonat

(10) Patent No.: US 7,422,018 B2
(45) Date of Patent: Sep. 9, 2008

(54) PACKAGING CASES FOR A COSMETIC PRODUCT WITH IMPROVED ERGONOMICS

(75) Inventor: Fabrice Dieudonat, Fosses (FR)

(73) Assignee: Alcan Packaging Beauty Services (FR)

( * ) Notice: Subject to any disclaimer, the term of this patent is extended or adjusted under 35 U.S.C. 154(b) by 0 days.

(21) Appl. No.: 11/559,481

(22) Filed: Nov. 14, 2006

(65) Prior Publication Data

US 2007/0108094 A1 May 17, 2007

(30) Foreign Application Priority Data

Nov. 15, 2005 (FR) ..... 0511556

(51) Int. Cl.
*A45D 33/24* (2006.01)
*B65D 69/00* (2006.01)

(52) U.S. Cl. ..... 132/294; 132/301; 206/581; 220/810

(58) Field of Classification Search ..... 206/581, 206/823; 132/293, 294, 297, 301, 304; 220/810, 220/843, 844

See application file for complete search history.

(56) References Cited

U.S. PATENT DOCUMENTS

D148,815 S * 2/1948 Olevin ..... D28/77
4,392,503 A 7/1983 Watanabe et al.
4,936,324 A * 6/1990 Chen ..... 132/294
6,640,813 B2 * 11/2003 Raisner et al. ..... 132/200
6,997,321 B2 * 2/2006 Young ..... 206/581
7,140,372 B2 * 11/2006 Byun ..... 132/287

FOREIGN PATENT DOCUMENTS

FR 932902 4/1948
FR 2755353 5/1998

* cited by examiner

*Primary Examiner*—Luan K Bui
(74) *Attorney, Agent, or Firm*—Banner & Witcoff, Ltd.

(57) ABSTRACT

A cosmetic case, in an embodiment, comprises a lid provided with a mirror and fitted with a first hinge portion, a hollow bottom adapted to contain at least one cosmetic product, the bottom including a second hinge portion, (wherein a hinge with rotation axis R is formed by cooperation between the first and second hinge portions), a snap closure and an applicator.

The cosmetic case is characterized in that:

a) the case is quadrangular in shape with four corners and two approximately parallel gripping sides defining a longitudinal direction, and b) the rotation axis R is located in one of the four corners, such that when the case is open, the lid in which the mirror is fitted is offset from the bottom, the bottom being held by one hand on the approximately parallel gripping sides.

20 Claims, 4 Drawing Sheets

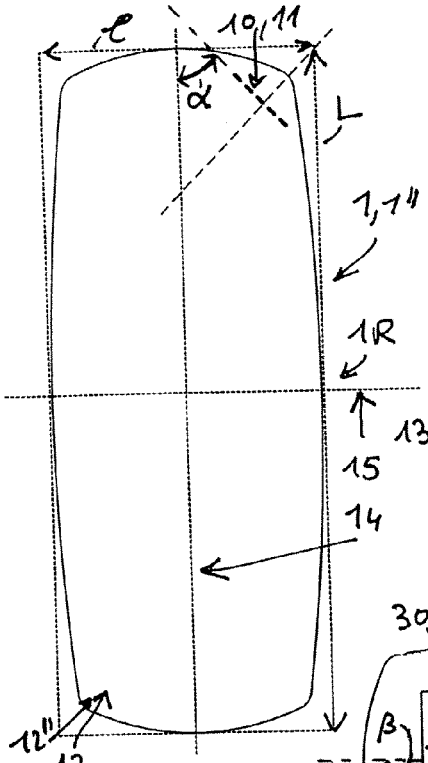
FIG. 1c
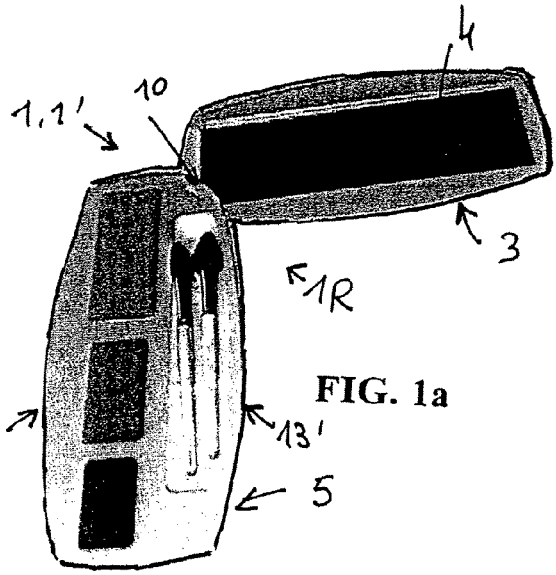
FIG. 1a
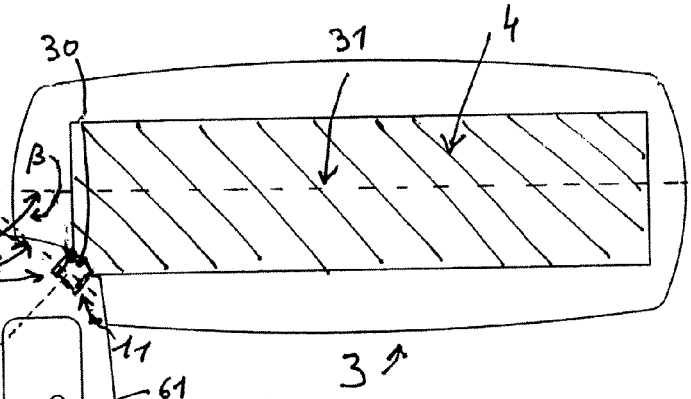
FIG. 1b
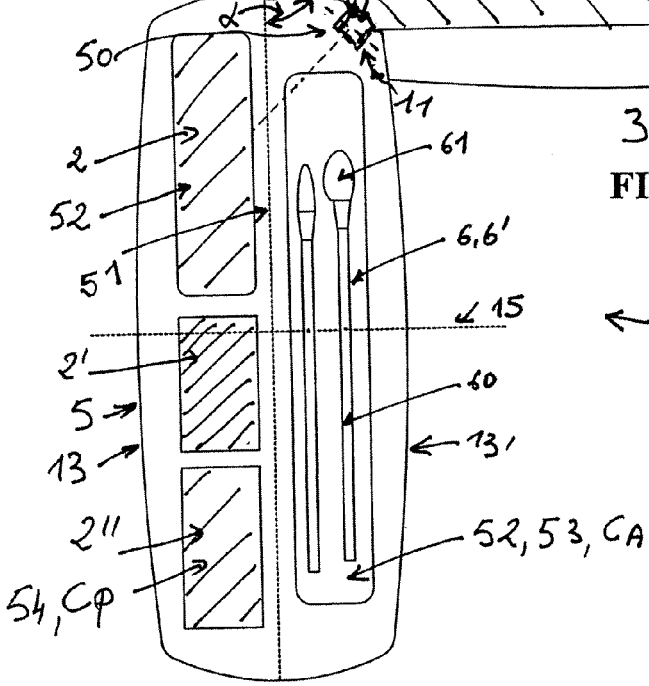

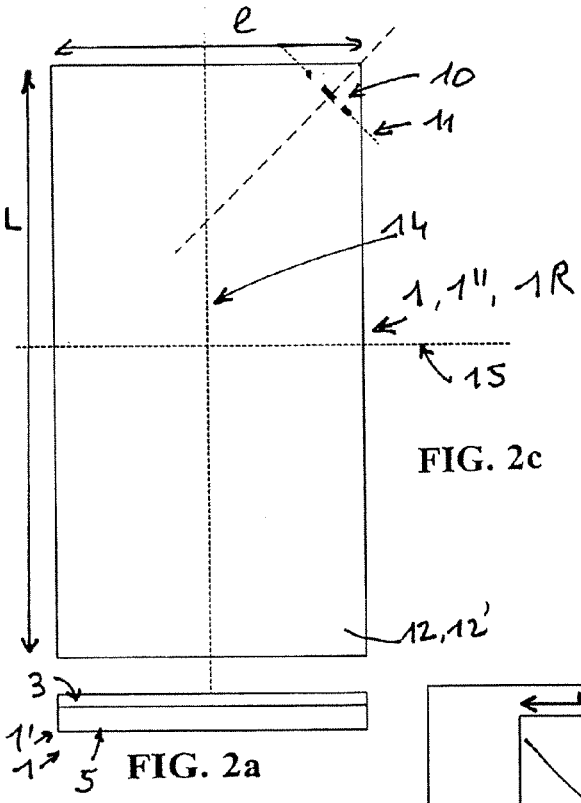
FIG. 2c
FIG. 2a
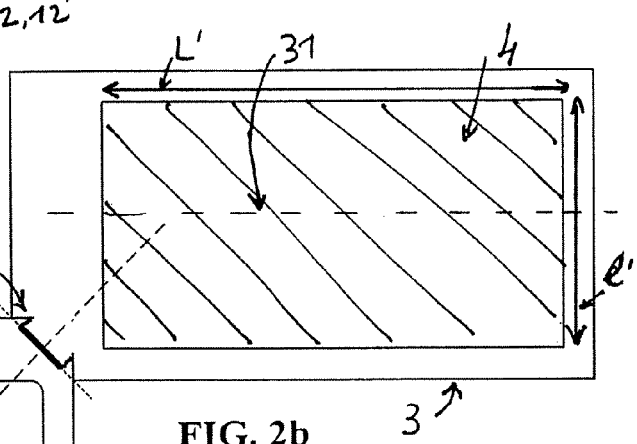
FIG. 2b
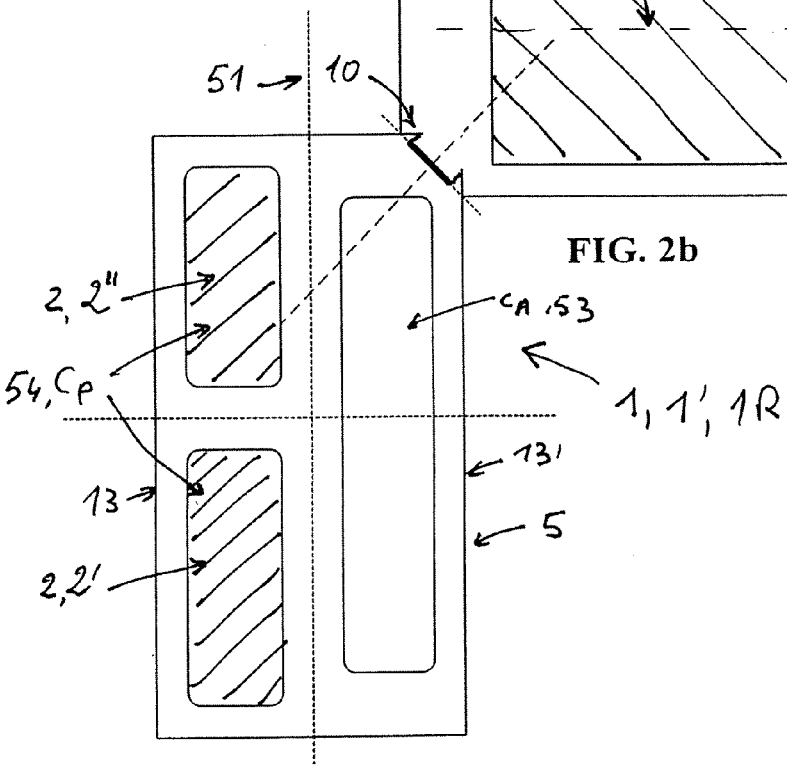

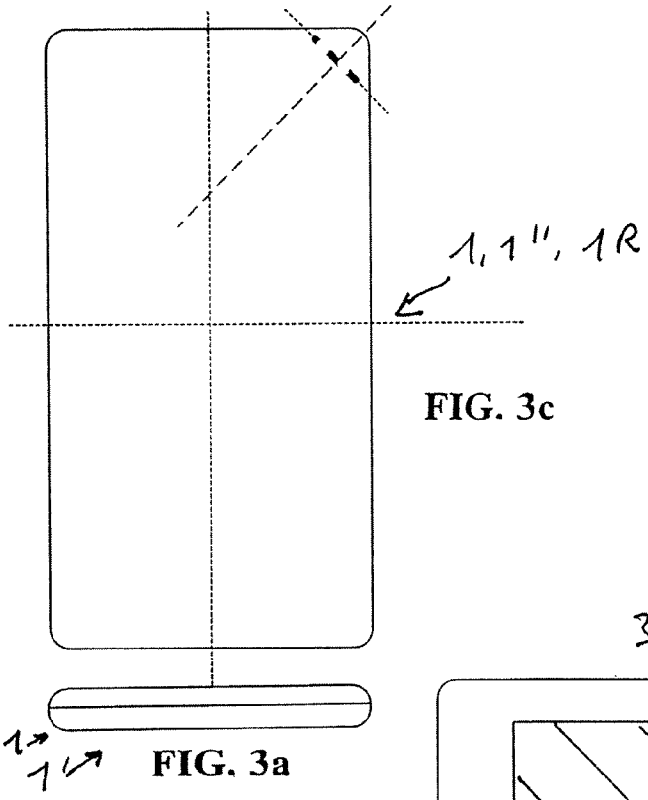
FIG. 3c
FIG. 3a
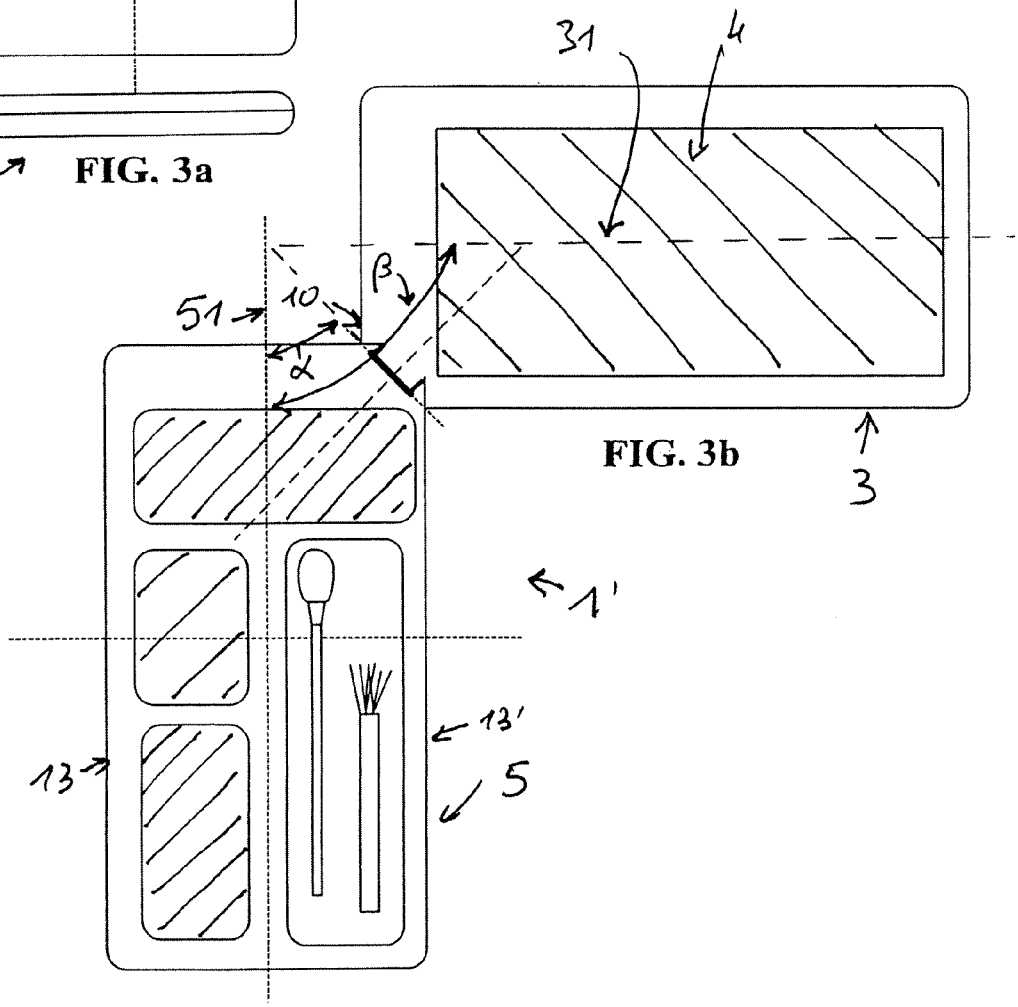
FIG. 3b

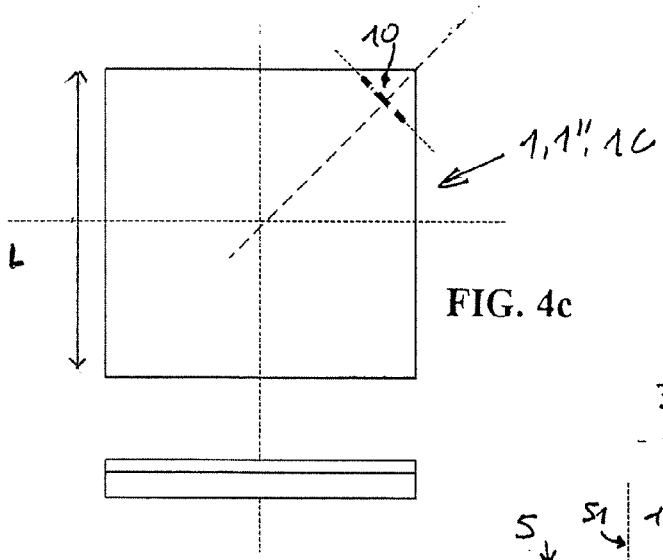
FIG. 4c
FIG. 4a
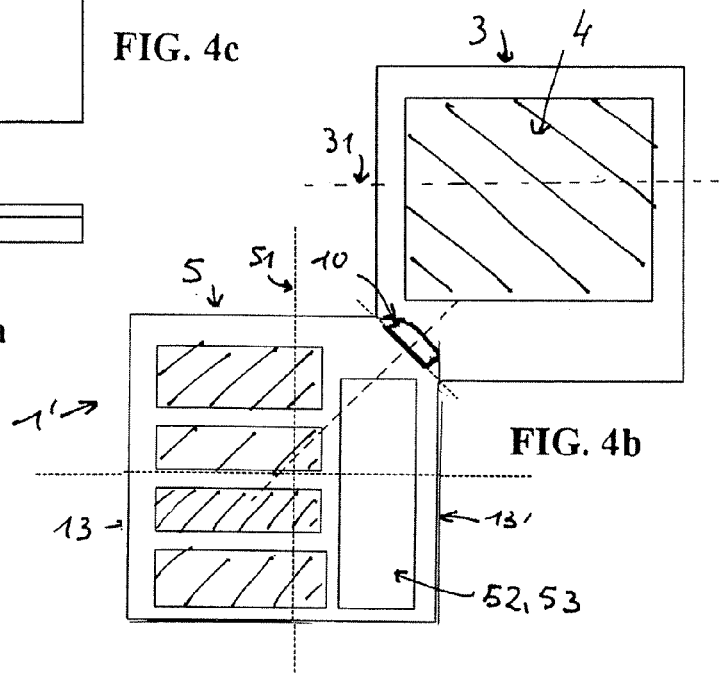
FIG. 4b
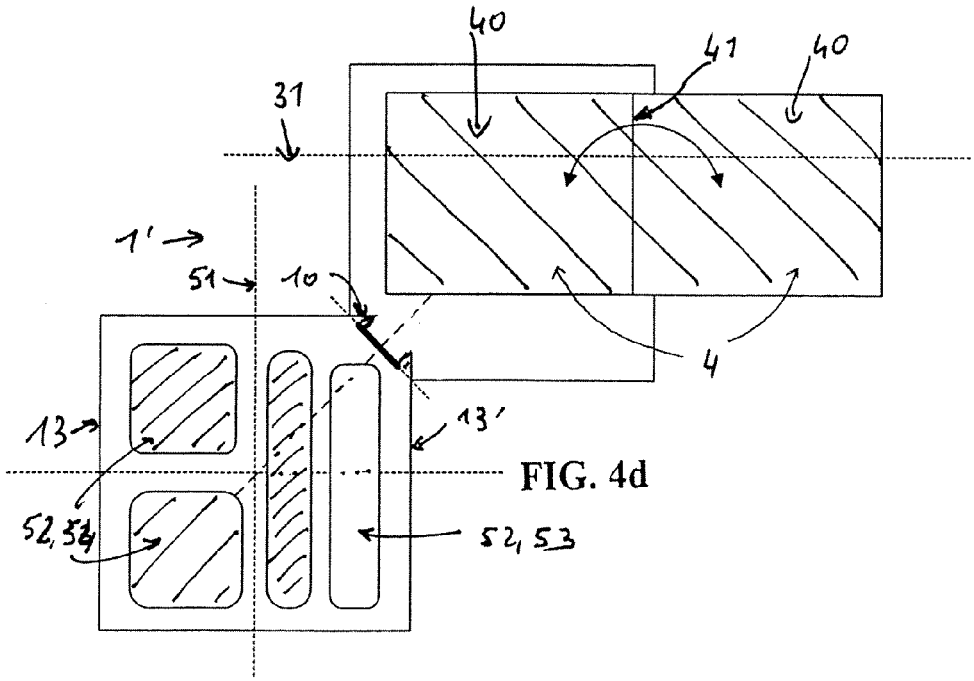
FIG. 4d

PACKAGING CASES FOR A COSMETIC PRODUCT WITH IMPROVED ERGONOMICS

CROSS-REFERENCE TO RELATED APPLICATION

This application claims priority to French Application No. FR 0511556 filed Nov. 15, 2005, which is incorporated herein by reference.

BACKGROUND OF THE INVENTION

1. Field of the Invention

The invention relates to the domain of packaging for cosmetics, including packaging for make-up cases for face care, including the eyes and lips.

2. Background

Cosmetic cases can comprise a hollow lid that can be fitted with a mirror on the inside; a hollow bottom that can be fitted with a mesh or intermediate support for at least one cup that can contain a cosmetic product; a hinge forming the connecting device between the lid and the bottom, through which the lid is articulated and used to open the case; and a snap closure or other means of locking and unlocking the lid from the bottom to open and close the case, the closure can be of the push button type. This snap closure can be located on the side of the case opposite the hinge, and can involve cooperation between an element on the lid and an element on the bottom or on the mesh fixed to the bottom, to keep the case closed except when intentionally opened.

Numerous cases are known, and different embodiments may apply to one or several components of the case, particularly regarding the closing and opening of the case. Patents related to cases in the name of the applicant include: patent FR 2 661 080 that describes a make-up case with compact closing means; patent FR 2 725 958 that relates to a flush closing case with assisted opening; patent FR 2 737 192 that describes a case with a pivoting lid fitted with a hinge with flexible tabs; patent FR 2 755 352 that describes a case with assisted opening; patent FR 2 755 353 that describes a case with an unlocking and pre-opening pusher; patent FR 2 794 723 that describes a case with improved pre-opening; patent FR 2 844 158 that describes a case with magnetic closing; patent FR 2 844 434 that describes a case with side closing means; patent FR 2 846 631 that describes a case based on side support; and patent FR 2 850 256 that describes a case with a mobile rotating tray. Each of the patents enumerated herein are incorporated herein by reference.

Cosmetic cases can have a serious ergonomic weakness in that when cases are open so that powder can be applied, one hand holds the bottom while the other hand holds the application means, typically a tuft, swab, pad, brush or other soft applicator. The hand holding the bottom often can control the direction of the case and its lid to make use of the mirror located inside the lid, and in practice this makes it difficult for the application means to access the bottom.

Furthermore, in the domain of cases and packaging means for cosmetics, product ranges are renewed frequently so as to offer cases with new functions capable of satisfying existing and other needs.

Finally, it may be advantageous to have "one-hand cases", in other words, cases that can be held in one hand and opened by pressure applied by the hand holding the case.

BRIEF SUMMARY OF THE INVENTION

According to embodiments of the invention, a case that will be used for packaging cosmetics comprises a lid provided with a mirror and fitted with a first hinge portion, a hollow bottom comprising an intermediate mesh fixed to the bottom, and a cup that will contain the cosmetics, the bottom or the mesh being provided with a second hinge portion, a hinge with rotation axis R formed by cooperation between the first and second hinge portions, a means of locking and unlocking the lid to and from the bottom or the mesh and an applicator of the cosmetic product.

Embodiments of the case can be characterised such that a) the case is quadrangular in shape with four corners and two approximately parallel gripping sides, and b) the rotation axis R is located in one of the four corners such that when the case is open, the lid in which the mirror is fitted is offset from the bottom, the bottom being held by one hand on the approximately parallel gripping sides, to give excellent ergonomics.

In embodiments, the case can enable the lid and therefore also enable the mirror to be offset in position from the bottom held in one hand, such that the entire face can be seen in the mirror without being hindered by the bottom, which can make the ergonomics of the case more appropriate than cases without such a feature.

BRIEF DESCRIPTION OF THE FIGURES

In the figures, only the mirrors (4) and cavities or cups containing cosmetics (2, 2', 2", 2'") are shown cross-hatched for convenience in viewing the figures and to avoid overcrowding of the figures.

FIG. 1*a* to 1*c* relate to an embodiment of a case (1), the case (1) being a case (1R) that can be inscribed within a rectangle with length L and width l.

FIG. 1*a* is a photographic perspective view of an open case (1').

FIG. 1*b* is a top view of FIG. 1*a*.

FIG. 1*c* is a top view of a closed case (1"), showing the hinge (10) and its rotation axis (11) in a bold dashed line.

FIGS. 2*a* to 2*c* relate to an embodiment of a case (1R) that can be inscribed within a rectangle with length L and width l, the case (1R) having four right-angled corners (12, 12').

FIG. 2*a* is a front view of a closed case (1").

FIG. 2*b* is a top view of an open case.

FIG. 2*c* is a top view of a closed case.

FIGS. 3*a* to 3*c* relate to an embodiment of a case (1R) that can be inscribed within a rectangle with length L and width l, the case (1R) having four rounded corners (12, 12"). FIG. 3*a* is a front view of a closed case. FIG. 3*b* is a top view of an open case. FIG. 3*c* is a top view of a closed case.

FIGS. 4*a* to 4*c* relate to an embodiment of a case (1C) that can be inscribed within a square with side length L, the case (1C) having four right-angled corners (12, 12'). FIG. 4*a*is a front view of a closed case. FIG. 4*b* is a top view of an open case. FIG. 4*c* is a top view of a closed case.

FIG. 4*d* is a top view of an open case in which the mirror (4) comprises two parts (40) free to fold about a hinge (41).

The following references numbers relate generally to references in the figures:

Case . . . 1
Case that can be inscribed within a rectangle . . . 1R
Case that can be inscribed within a square . . . 1C
Open case . . . 1'
Closed case . . . 1"
Hinge . . . 10
Rotation axis of 10 . . . 11
Corners of 1 . . . 12
Right-angled corners . . . 12'
Rounded corners . . . 12'
Gripping sides . . . 13, 13'
Longitudinal direction . . . 14
Transverse direction . . . 15

Open plane of 1 . . . 16
Snap Closure . . . 17
Cosmetic product . . . 2
Lid . . . 3
First hinge portion . . . 30
Longitudinal direction . . . 31
Mirror . . . 4
Two-part mirror . . . 4'
Parts of 4' . . . 40
Auxiliary hinge . . . 41
Bottom . . . 5
Second hinge portion . . . 50
Longitudinal direction . . . 51
Cavity . . . 52
Cavity CA . . . 53
Cavity CP . . . 54
Applicator . . . 6
Brush . . . 6'
Handle . . . 60
Plurality of bristles . . . 61

DETAILED DESCRIPTION OF EMBODIMENTS OF THE INVENTION

A case (1) shows aspects of an embodiment of the invention as illustrated in FIGS. 1*c*, 2*c* and 3*c*. The case (1) may be a case (1R) with a longitudinal or oblong shape that can be inscribed within a rectangle with length L and width l, the case (1R) thus having a longest dimension L in the longitudinal direction (14) and a longest dimension 1 in a transverse direction (15) perpendicular to the longitudinal direction (14). The case (1R) can have an L/l ratio equal to not less than 1.5. The shape factor $F_B$ of the case is equal to the ratio L/l of the case. The angle α between the rotation axis R (11) of hinge (10) and longitudinal direction (14) may vary from 30° to 60°, such that when the case (1R) is open with the lid (3) and the bottom (5) in the same plane, the angle β between the longitudinal directions of the lid (3) denoted $L_C$ (31) and the bottom (5) denoted $L_F$ (51) is equal to 2.α, such that the lid (3) equipped with mirror (4) is offset from the bottom (5) when the case (1R) is open. The ergonomics of this case is excellent.

As can be seen in FIG. 1*a*, 2*b*, 3*b* and 4*b*, the shape of the mirror (4) may be similar to the shape of the case (1R). The shape factor $F_M$ of the mirror is equal to the L'/l' ratio of the mirror. The shape factor $F_M$, in an embodiment, can be equal to $F_B$±0.2, as illustrated on FIG. 2*b*. In an embodiment, the shape factor $F_B$ may be equal to no less than 2.

In an embodiment, the angle α may be equal to 45°, such that when the case (1R) is open with the lid and the bottom in the same plane, the angle β between the longitudinal directions of the lid $L_C$ (31) and the bottom $L_F$ (51) is equal to 90°.

As illustrated on FIG. 4*c*, the case (1) may be a case (1C) with a shape that can be inscribed within a square with side length L.

In this case, and as illustrated on FIG. 4*d*, the mirror (4) of the case (1C) may be a mirror (4') with two folding parts (40, 40), typically folding about an auxiliary hinge (41), such that when unfolded, the shape factor (length/width) of the mirror (4') is approximately equal to 2, and enables a larger view of the face, at least in a lateral direction.

According to an embodiment of the invention and as illustrated on FIGS. 2*c* and 4*c*, the corners (12) may be right-angled corners (12'). However, as illustrated on FIGS. 1*c* and 3*c*, in an embodiment, the corners (12) may be rounded corners (12").

According to embodiments of the invention, and as illustrated on FIGS. 1*a*, 1*b*, 2*b*, 3*b*, 4*b* and 4*d*, the bottom (5) may include or form a plurality of cavities (52), at least one of these cavities (52) being a longitudinal cavity $C_A$ (53) designed to house the applicator (6), at least one of these cavities (52) being a cavity $C_P$ (54) designed to house at least one of the cosmetics (2).

As illustrated on FIG. 2*b*, the bottom (5) may comprise one longitudinal cavity $C_A$ (53) and at least two cavities $C_P$ (54) aligned along the longitudinal direction (14).

As illustrated on FIG. 1*b*, the bottom (5) may comprise one longitudinal cavity $C_A$ (53) and three cavities $C_P$ (54) aligned along the longitudinal direction (14).

According to one embodiment of the invention, the snap closure (also known as the closing means or locking means) may comprise a magnet fitted on the edge of the bottom (5) or the lid (3) and a metallic part that can be attracted by the magnet, due to magnetic forces, housed facing each other on the edge of the lid (3) or the bottom (5). This is true for the cases shown on the figures.

In another embodiment, the closing mechanism may comprise a hook fixed to the lid free to cooperate with a push button fixed to the bottom, such that manual pressure applied on the push bottom releases the lid.

According to one variant of a hinge that operates as a closing means, the hinge (10) may comprise a spring such that the lid opens automatically when manual pressure is applied. In another embodiment, the hinge operates in response to manual lifting of the lid.

Advantageously, the push button may be a side push button to obtain a so-called "one-hand" case, in which one finger of the hand holding the bottom of the case can be used to apply the manual pressure. Additional closing means can be used, such as releasable adhesives, magnets and metallic pieces fitted at other portions of the case and its parts, male and female cooperating members, latches, fasteners, string, Velcro and similar closing means.

As illustrated on FIGS. 1*b* and 3*b*, the applicator (6) may comprise at least one longitudinal brush (6') at least 0.5.L long, the brush having a handle (60) with a plurality of bristles (61) at one end.

According to embodiments of the invention and as illustrated on FIGS. 1*b*, 2*b*, 3*b*, 4*b* and 4*d*, the hinge (10) may be a so-called "right" hinge (10') because it is located at the right of a longitudinal half-plane passing through the longitudinal direction (14), such that when the case is open, the lid (3) equipped with the mirror (4) is offset to the right from the bottom (5).

However, according to one symmetric embodiment not illustrated on any of the figures, the hinge (10) may be a so-called "left" hinge because it is located at the left of a longitudinal half-plane passing through the longitudinal direction (14), such that when the case is open, the lid (3) equipped with the mirror (4) is offset to the left from the bottom (5).

It is important in some embodiments to have cases suitable for use by right-handed or left-handed users who have their own preferred hand for holding the bottom (5) by manual pressure between the thumb and one or several fingers on the gripping sides (13, 13') of the case and the bottom (5).

With a "right" hinge, the bottom (5) is held in the left hand and the applicator is manipulated with the right hand. Obviously, the situation is reversed in the case of a "left" hinge.

Another purpose of embodiments of the invention is the use of a case (1) according to the invention for packaging of a cosmetic product (2) designed for cosmetics including face make-up, make-up of the eyes and lips, consisting of make-up, a powder or a cream.

EXAMPLES

Cases (1) were made according to FIGS. 1*a* to 4*d*. This was done by molding plastic materials to make lids (3) provided with a cavity in which the mirror (4) can be placed and fixed, possibly with an adhesive, equipped with their first hinge portion (20), and bottoms (5) with cavities (52, 53, 54), and their second hinge portion (50).

The lids and the corresponding bottoms were assembled by forming the hinge (10) conventionally, for example by using a central hinge pin, the first portion (30) and second portion (50) of hinge cooperating to form a hub fixed by the central hinge pin.

The case according to embodiments of the invention has much better ergonomics than many cases used in the past. This is particularly striking considering the open case (1') in FIGS. 1*b*, 2*b*, 3*b* and 4*d*. In one example of the invention, the user can hold her product pallet or colour pallet in one hand and see her complete face, or at least the full width of the face if not the full height, the width being naturally more important because normally make-up on the left and right sides of the face has to be applied identically, at the eyes, at the cheeks and at the lips.

The invention claimed is:

1. A case for one or more cosmetics, comprising: (a) a lid including a mirror and fitted with a first hinge portion, (b) a hollow bottom comprising an intermediate mesh fixed to the hollow bottom, and (c) a cup adapted to contain at least one cosmetic product, wherein the hollow bottom includes a second hinge portion, wherein a hinge with rotation axis R is formed by cooperation between the first hinge portion and the second hinge portion, a closing means for locking and unlocking the lid to and from the hollow bottom or the mesh, and an applicator, wherein a) the case is quadrangular in shape with four corners and two approximately parallel gripping sides, the approximately parallel sides defining a longitudinal direction, and b) the rotation axis R is located in approximately one of the four corners, such that when the case is open, the lid in which the mirror is fitted is offset from the hollow bottom, and wherein the case has a shape that is longitudinal or oblong and can be inscribed within a rectangle with length L and width l, the case having a longest dimension in the longitudinal direction defined as L, and the case having a longest dimension in a transverse direction perpendicular to the longitudinal direction defined as l, wherein a shape factor $F_B$ is defined as the ratio L/l, and wherein the shape factor $F_B$ is equal to at least 1.5, and wherein the angle between the rotation axis R of the hinge and the longitudinal direction is defined as angle $\alpha$, and wherein angle $\alpha$ is between approximately 30° to 60°, and wherein the lid has a longitudinal direction defined as $L_C$, and the hollow bottom has a longitudinal direction defined as $L_F$ and wherein the angle between $L_C$ and $L_F$ is defined as angle $\beta$ and wherein angle $\beta$ is equal to $2\alpha$ when the case is open and the lid and the bottom are in the same plane, and wherein the lid containing the mirror is offset from the hollow bottom when the case is open.

2. The case according to claim 1 wherein the mirror has a length L' and a width l', and wherein the ratio L'/l' defines a shape factor $F_M$, and wherein the ratio L/l defines a shape factor $F_B$, and wherein the shape factor $F_M$ is between 20% less than the shape factor $F_B$ and 20% more than shape factor $F_B$.

3. The case according to claim 1 wherein the shape factor $F_B$ is equal to at least 2.

4. The case according to claim 1 wherein the angle $\alpha$ is equal to approximately 45° and the angle $\beta$ is equal to approximately 90°.

5. The case according to claim 1 wherein the case has a shape that can be inscribed within a square with side length L.

6. The case according to claim 5 wherein the mirror comprises two folding parts which fold about an auxiliary hinge and wherein the shape factor $F_M$ of the mirror is approximately equal to 2.

7. The case according to claim 1, wherein the corners are right-angled corners.

8. The case according to claim 1, wherein the corners are rounded corners.

9. The case according to claim 1 wherein the hollow bottom includes a plurality of cavities, and wherein at least one of these cavities is a longitudinal cavity defined as $C_A$ and is sized to house an applicator, and wherein at least one of these cavities defined as cavity $C_P$ and is sized to house at least one of the one or more cosmetics.

10. The case according to claim 9 wherein the hollow bottom further comprises a third cavity and wherein cavity $C_P$ and the third cavity are aligned along the longitudinal direction.

11. The case according to claim 10 wherein the bottom comprises a fourth cavity aligned along the longitudinal direction.

12. The case according to claim 1 wherein the closing means comprises a magnet fitted on an edge of the hollow bottom or the lid and a metallic part that can be attracted by the magnet, due to magnetic forces, wherein the magnet and the metallic part are housed facing each other on the edge of the lid or the bottom.

13. The case according to claim 1 wherein the closing means comprises a hook fixed to the lid, free to cooperate with a push button fixed to the hollow bottom, wherein the application of manual pressure to the push bottom releases the lid.

14. The case according to claim 13 wherein the hinge comprises a spring and wherein the lid opens automatically when manual pressure is applied.

15. The case according to claim 14 wherein the push button is a side push button that can be pushed by one finger of the hand of the user holding the bottom of the case.

16. The case according to claim 1 wherein the applicator comprises at least one longitudinal brush at least 0.5.L long, the brush comprising a handle and a plurality of bristles.

17. The case according to claim 1 wherein the hinge is located at the right of a longitudinal half-plane passing through the longitudinal direction, such that when the case is open, the lid equipped with the mirror is offset to the right from the hollow bottom.

18. The case according to claim 1 wherein the hinge is located at the left of a longitudinal half-plane passing through the longitudinal direction, such that when the case is open, the lid equipped with the mirror is offset to the left from the hollow bottom.

19. The case according to claim 5 wherein the mirror enables a complete view in the lateral direction of the face of the person using the case and looking into the mirror.

20. A case adapted for a cosmetic, comprising: (a) a lid including a mirror and a first hinge portion, (b) a hollow bottom comprising an intermediate mesh fixed to the hollow bottom, and (c) a cup adapted to contain at least one cosmetic product, wherein the hollow bottom includes a second hinge portion, wherein a hinge with rotation axis R is formed by cooperation between the first hinge portion and the second hinge portion, a closer and an applicator, wherein a) the case is quadrangular in shape with four corners and two approximately parallel gripping sides, the approximately parallel sides defining a longitudinal direction, and b) the rotation axis R is located in approximately one of the four corners, such that when the case is open, the lid in which the mirror is fitted is offset from the hollow bottom, and wherein, the case has a shape that is longitudinal or oblong and can be inscribed within a rectangle with length L and width l, the case having a longest dimension in the longitudinal direction defined as L, and the case having a longest dimension in a transverse direction perpendicular to the longitudinal direction defined as l, the case having a shape factor $F_B$ defined as the ratio L/l, and wherein the shape factor $F_B$ is equal to at least 1.5, and wherein the angle between the rotation axis R of the hinge and the longitudinal direction is defined as angle $\alpha$, and wherein angle $\alpha$ is between approximately 30° to 60°, and wherein the lid has a longitudinal direction defined as $L_C$, and the hollow bottom has a longitudinal direction defined as $L_F$ and wherein the angle between $L_C$ and $L_F$ is defined as angle $\beta$ and wherein angle $\beta$ is equal to $2\alpha$ when the case is open and the lid and the bottom are in the same plane, and wherein the lid containing the mirror is offset from the hollow bottom when the case is open, and wherein the mirror has a length L' and a width l' and wherein the ratio L'/l' defines a shape factor $F_M$, and wherein the ratio L/l defines a shape factor $F_B$, and wherein the shape factor $F_M$ is between 20% less than the shape factor $F_B$ and 20% more than shape factor $F_B$.

* * * * *